US008814501B2

(12) United States Patent
Shoji et al.

(10) Patent No.: US 8,814,501 B2
(45) Date of Patent: Aug. 26, 2014

(54) FAN WITH AREA EXPANSION BETWEEN ROTOR AND STATOR BLADES

(75) Inventors: Hirofuni Shoji, Ishikawa (JP); Yousef Jarrah, Tucson, AZ (US); Kevin Wackerly, Tucson, AZ (US)

(73) Assignee: Minebea Co., Ltd. (Minebea), Nagano (JP)

( * ) Notice: Subject to any disclaimer, the term of this patent is extended or adjusted under 35 U.S.C. 154(b) by 583 days.

(21) Appl. No.: 13/166,479

(22) Filed: Jun. 22, 2011

(65) Prior Publication Data

US 2012/0034083 A1 Feb. 9, 2012

Related U.S. Application Data

(60) Provisional application No. 61/371,243, filed on Aug. 6, 2010.

(51) Int. Cl.
*F01D 5/22* (2006.01)
*F04D 29/54* (2006.01)
*F04D 25/06* (2006.01)

(52) U.S. Cl.
CPC ..... *F04D 29/542* (2013.01); *F04D 25/0613* (2013.01); *F04D 29/545* (2013.01)
USPC ..... 415/119; 415/191; 415/208.2; 415/214.1; 415/218.1; 415/220

(58) Field of Classification Search
USPC ..... 415/119, 191, 208.1, 208.2, 211.2, 415/214.1, 215.1, 218.1, 219.1, 220, 222
See application file for complete search history.

(56) References Cited

U.S. PATENT DOCUMENTS

| | | | | |
|---|---|---|---|---|
| 4,583,911 | A * | 4/1986 | Braun | 415/116 |
| 4,895,489 | A * | 1/1990 | Kohama et al. | 415/218.1 |
| 7,380,955 | B2 * | 6/2008 | Lu et al. | 362/96 |
| 7,726,939 | B2 * | 6/2010 | Lee et al. | 415/211.2 |
| 7,824,154 | B2 * | 11/2010 | Yabuuchi | 415/211.2 |
| 8,113,775 | B2 * | 2/2012 | Yoshida | 415/220 |
| 8,147,203 | B2 * | 4/2012 | Chen et al. | 416/204 R |
| 8,651,807 | B2 * | 2/2014 | Inada et al. | 415/208.2 |

FOREIGN PATENT DOCUMENTS

JP 2000-179490 6/2000

* cited by examiner

*Primary Examiner* — Igor Kershteyn
(74) *Attorney, Agent, or Firm* — Fountainhead Law Group, P.C.

(57) ABSTRACT

An axial-flow fan structure is disclosed, having a localized area expansion between the rotor (i.e. front rotating impeller) and stator blades (i.e. rear stationary or fixed blades, sometimes called de-swirl vanes). The area expansion is provided by utilizing an impeller having a (slightly) falling tip contour (FTC).

14 Claims, 7 Drawing Sheets

FAN WITH AREA EXPANSION BETWEEN ROTOR AND STATOR BLADES

CROSS-REFERENCES TO RELATED APPLICATIONS

This application claims priority to U.S. Provisional Application No. 61/371,243 filed Aug. 6, 2010 and is incorporated herein in its entirety for all purposes. This application is related to commonly owned U.S. application Ser. No. 12/629,699, filed Dec. 2, 2009 which is incorporated herein in its entirety for all purposes.

BACKGROUND

Modern electronic devices, for example, personal computers and copiers which enclose a large number of electronic parts inside a relatively small housing, tend to retain heat generated by these electronic parts. The generated heat may possibly damage these electronic parts. In order to prevent such damage, air through-holes are typically provided on side walls of the device housing and top surfaces of the housing. A fan installed near the air through-holes may then remove the heat that is generated inside the housing.

BRIEF SUMMARY

Embodiments according to the present invention provide an axial-flow fan structure with localized area expansion between the rotor (i.e. front rotating impeller) and stator blades (i.e. rear stationary or fixed blades, sometimes called de-swirl vanes). In embodiments, the area expansion may utilize an impeller with a (slightly) falling tip contour (FTC), thus providing effective reduction of the sound power level (fan noise).

Embodiments of the present invention relate to an axial flow fan device. Specifically, certain embodiments relate to a small axial flow fan device used to exhaust heat generated by electronic parts inside a housing. More particularly, embodiments of the present invention relate to axial flow fans having an area expansion region between the rotor and stator blades to reduce the sound power level.

Embodiments of the present invention can increase static pressure and air flow, while at the same time decreasing sound power level (noise level) by controlling the airflow and preventing pressure loss during exhaust of the air. In embodiments, an axial flow fan can be reduced in size without having to reduce the circuit board that is used to control the axial flow fan and without obstructing air flow. In an embodiment, the circuit board for driving the fan motor can be disposed parallel to the axis of rotation. In an embodiment an axially disposed circuit board storage portion may be providing in the fan housing for receiving a circuit board for controlling the fan motor.

Embodiments of the present invention provide an axial flow fan having blade shapes which would allow a reduction of surface area of a fan inside its housing. In embodiments, such reduction in surface area may be provided around the trailing edges of the fan blades. Consequently, aerodynamic force exerted on the fan can be reduced. The inside of the fan housing may be narrowed along a trajectory line in the direction from a tip of the fan blade toward the rotational axis.

DETAILED DESCRIPTION

Figure 1:
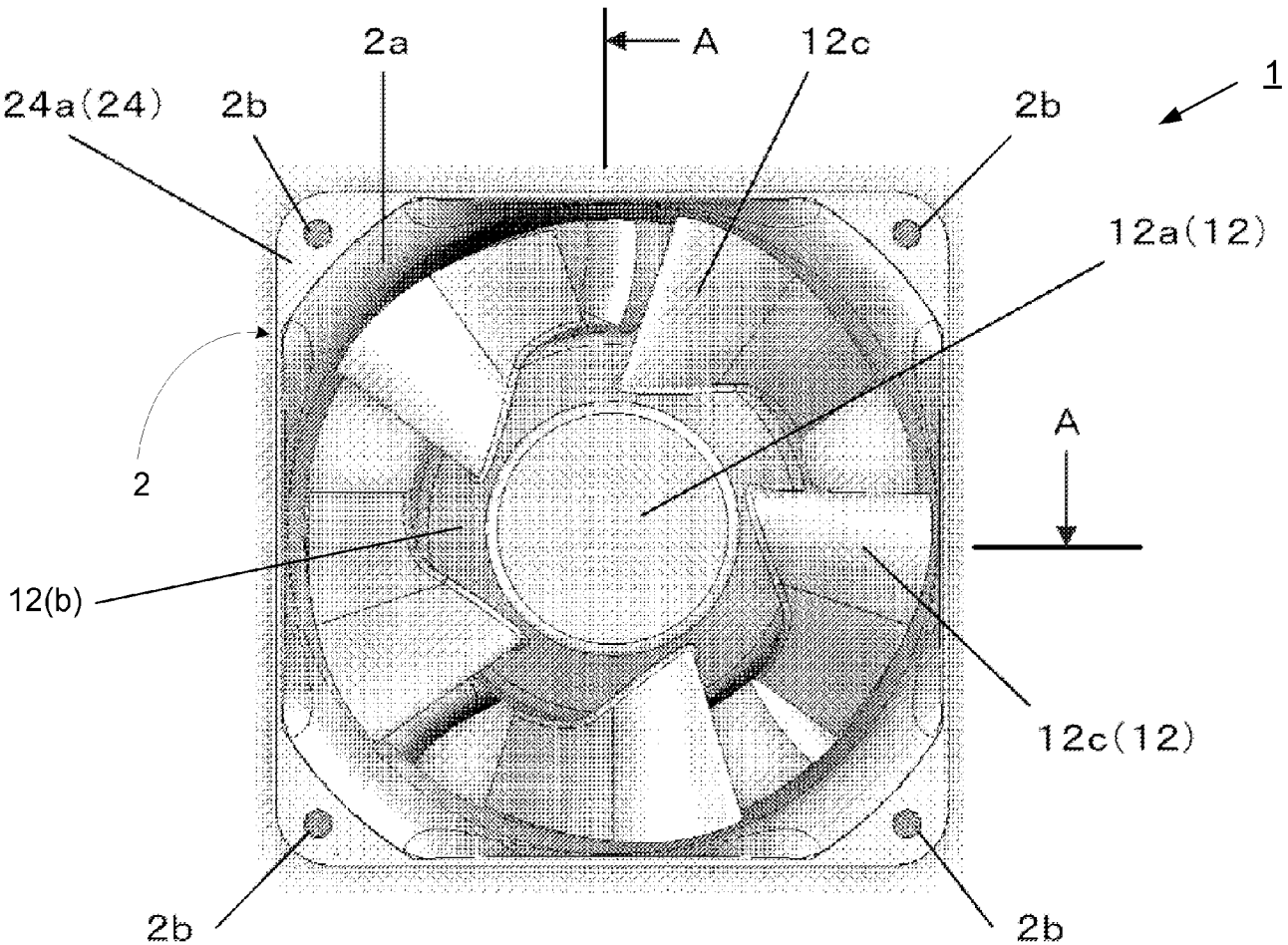
FIG. 1 shows a plan view of an axial flow fan device in accordance with an embodiment of the present invention.

FIG. 1 illustrates a front-facing view of an embodiment of a fan 1 in accordance with the present invention. In embodiments, the fan 1 may be an axial flow fan. In embodiments, the fan may include a fan housing 2 having an impeller 12 disposed within the fan housing. The impeller 12 may comprise an impeller body 12*a* having fan blades 12*c* connected to a hub 12*b*. An air flow opening 2*a* may be formed in a central part of the fan housing 2. The fan housing 2 may include an inlet housing ring 24 having a flange 24*a* provided with installation through-holes 2*b* for installation in an electronic device to be cooled (not shown).

Figure 1A:
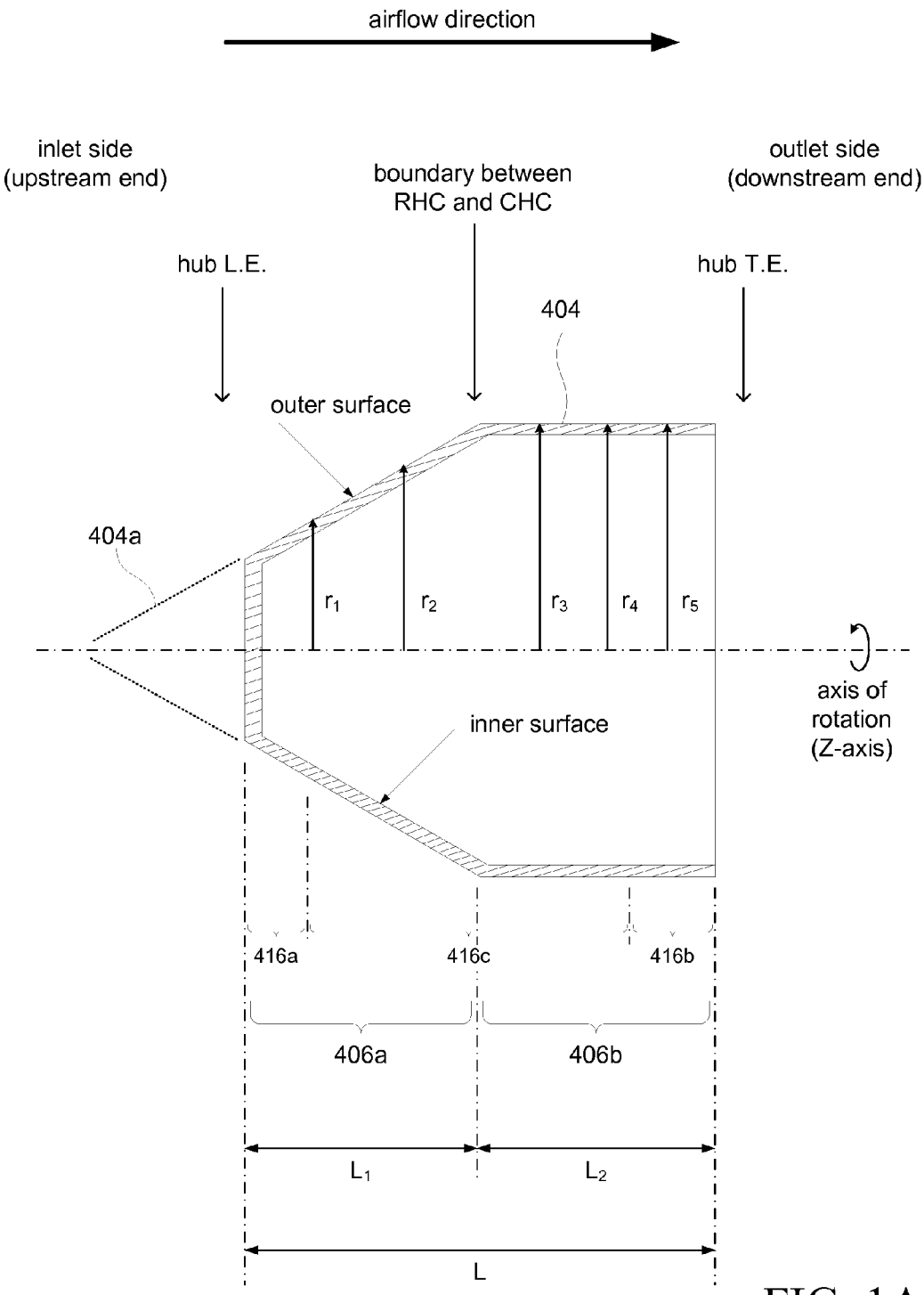
FIG. 1A shows an embodiment of a hub having a rising hub contour.

In an embodiment, the hub 12*b* may have a rising hub contour. This can be seen in the front-facing view of the impeller body 12*a* shown in FIG. 1. Referring for a moment to FIG. 1A, the rising hub contour can be seen in the cross-sectional view.

FIG. 1A shows a cross-sectional view of a hub 404 of an embodiment of the present invention. The figure is a diagrammatic, illustrative representation, and as such the illustrated structures are not necessarily to scale. The cross-sectional view can be referred to as the "hub profile" or the "hub contour" (outer surface of the hub to which the fan blades are attached). Physical features of the hub profile illustrated in the figure are exaggerated to facilitate the illustration of aspects of the present invention. In an embodiment of the hub 404, the front of the hub can extend further than is illustrated in the figure; this is indicated by the dashed outline 404*a*. The figure shows an axis of rotation; a counterclockwise rotation is shown as an example. The direction of airflow is indicated in the figure, where a flow of air enters at the inlet side and exits from the outlet side. The inlet (upstream) side of the hub 404 can be referred to as the hub leading edge (hub LE). The outlet (downstream) side of the hub 404 can be referred to as the hub trailing edge (hub TE).

In an embodiment, the hub 404 may comprise a first portion 406*a* and a second portion 406*b*. The first portion 406*a* can be characterized as having a rising hub contour (RHC) in that the radius, r, of the hub 404 varies along the axial length of the first portion. The radius is the distance measured from the axis of rotation to the outer surface (hub contour) of the hub 404. In FIG. 1A, radii $r_1$-$r_5$ are examples of radius measurements of the hub contour along the length of the axis of rotation, measured from the axis of rotation to the outer surface of the hub 404. In an embodiment, the radius of the first portion 406*a* of the hub 404 may increase along the axial direction from the hub leading edge toward the hub trailing edge. FIG. 1A shows an example of radii $r_1$ and $r_2$ in the first portion 406*a* measured from the axis, where $r_2>r_1$.

FIG. 1A shows an example of radii $r_3$, $r_4$ and $r_5$ in the second portion 406*b* taken along the z-axis. In embodiments, the second portion 406*b* of the hub 404 may be characterized as having a substantially constant radius (CHC, constant hub contour) where $r_3$ is substantially equal to $r_4$, which in turn is substantially equal to $r_5$. In embodiments, the second portion 406*b* of the hub 404 may be characterized as having a slight expansion. However, the rate of change of the radius along the z-axis in the second portion 406*b* may occur at a smaller rate than the rate of change of the radius along the z-axis in the first portion 406*a*, where for example $r_3$ may be slightly greater than $r_4$, which in turn may be slightly greater than $r_5$ (not shown).

In an embodiment, the hub 404 can be further characterized by a total axial length, L. The axial length of the first portion 406*a* can be represented by $L_1$ and the axial length of the second portion 406*b* can be represented by $L_2$, where $L=L_1+L_2$. The figure also shows a leading edge portion 416*a* of the hub 404, a trailing edge 416*b* of the hub, and a middle portion 416*c* of the hub. The leading edge portion 416*a* is a "front part" of the first portion 406*a* of the hub 404. The trailing edge portion 416*b* is a "rearward part" of the second portion 406*b* of the hub 404. These portions of the hub are discussed further below.

FIG. 1A shows the RHC-CHC boundary disposed between the hub leading edge end of the hub and the hub trailing edge end of the hub. The RHC-CHC boundary need not be a sharp angled transition such as shown in the figure. In embodiments of the hub, the transition at the RHC-CHC boundary can be a curved, smooth, or otherwise continuous transition.

Further details of the rising hub contour are disclosed in commonly owned co-pending U.S. application Ser. No. 12/629,699, which is incorporated by reference herein in its entirety for all purposes. It will be understood, that other embodiments may not use a rising hub contour (RHC) type of hub for its impeller.

Figure 2:
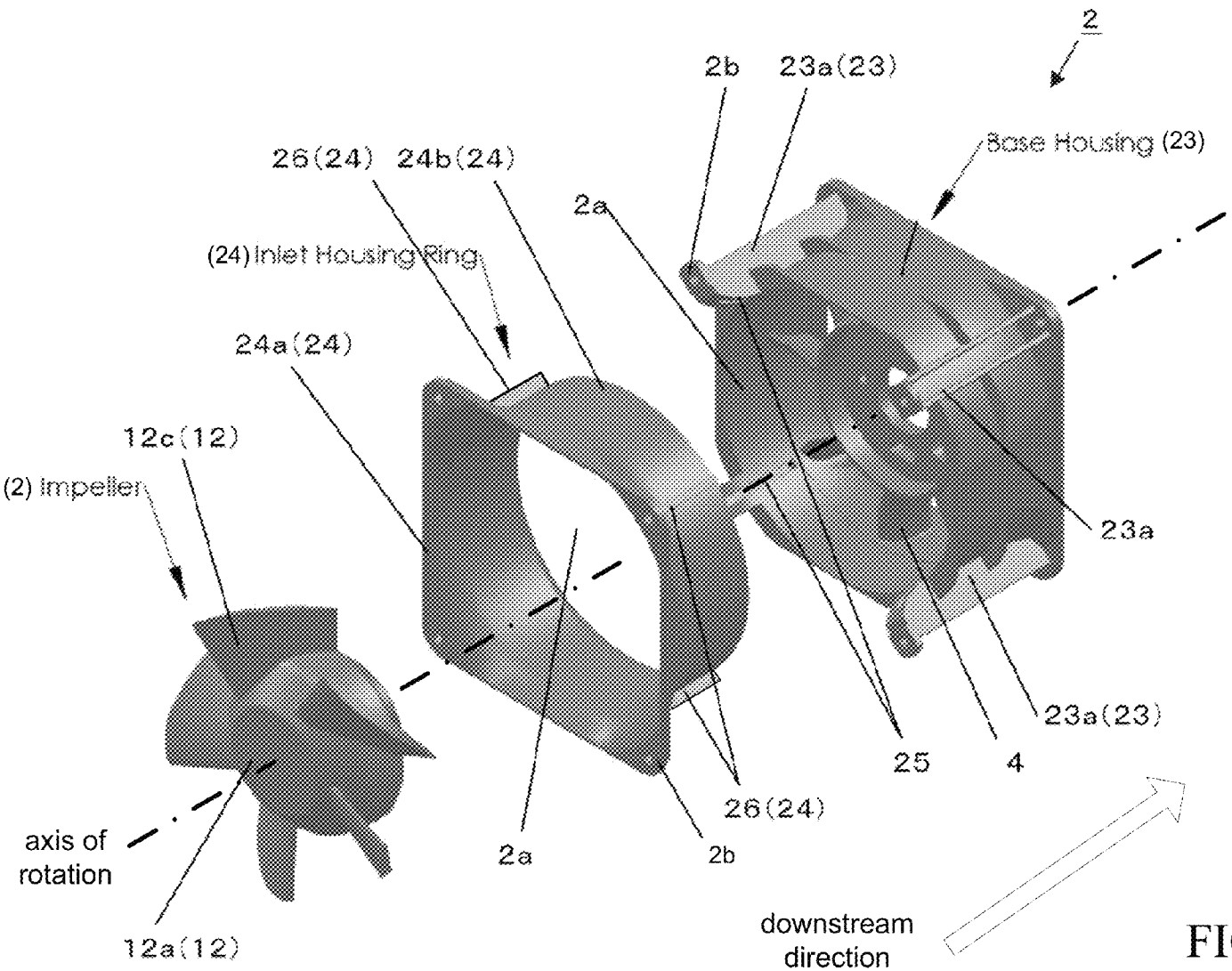
FIG. 2 shows a detailed perspective view of a housing of an axial flow fan device in accordance with an embodiment of the present invention.

FIG. 2 is an exploded view of the fan housing 2, showing additional detail of the fan housing in accordance with the present invention. To the left of the figure is the impeller 12. The inlet housing ring 24 further includes a ring part 24*b* joined to the flange 24*a*. Key grooves 26 may be provided on the ring part 24*b* of the inlet housing ring. The key grooves 26 can be aligned with the installation through-holes 2*b* in the flange 24*a*. The flange 24*a*, ring part 24*b*, and key part 25 may be formed as a single part by known injection molding processes using conventional resin materials including synthetic resins such as polybutylene terephthalate (PBT), acrylonitrile butadiene styrene (ABS), and the like to form the inlet housing ring 24.

The inlet housing ring 24 may attach to a base housing 23. More specifically, in the illustrated embodiment, the installation through-holes 2*b* provided in the inlet housing ring 24 may align with corresponding through-holes 2*b* provided in the base housing 23. Mounting receptacles 23*a* may be provided on the base housing 23, into which the through-holes 2*b* open.

Suitable connectors, such as screws inserted through the through-holes 2*b* provided in the inlet housing ring 24 and received in the mounting receptacles 23*a* of the base housing 23, may be used to securely connect the inlet housing ring to the base housing to constitute the fan housing 2. The key grooves 26 facilitate alignment of the inlet housing ring 24 relative to the base housing 23 by virtue of their alignment with corresponding key grooves 25 formed in the base housing. The impeller 12 is disposed within the air flow opening 2*a* defined by the openings of the inlet housing ring 24 and the base housing 23.

In embodiments, a plurality of fixed non-rotating fan blades (stator blades) 4 may be radially disposed in the base housing 23 about the axis of rotation. The fixed fan blades 4 may be omitted in other embodiments. The fixed fan blades 4 are discussed in further detail below.

In embodiments of the present invention, the radius of the airflow opening 2*a*, measured from the axis of rotation of the impeller 12, may decrease in the axial direction in the downstream direction and then increase with further travel in the downstream direction. In embodiments of the present invention, the radius of the impeller tip contour (measured from the axis of rotation) may decrease in the axial direction in the downstream direction. The impeller tip contour is the periphery of a circular area defined from a position on the tip of a rotating impeller. The size (radius, diameter) of the impeller tip contour may vary depending on the position on the tip of the impeller. This aspect of the present invention will be discussed in further detail below.

Figure 3:
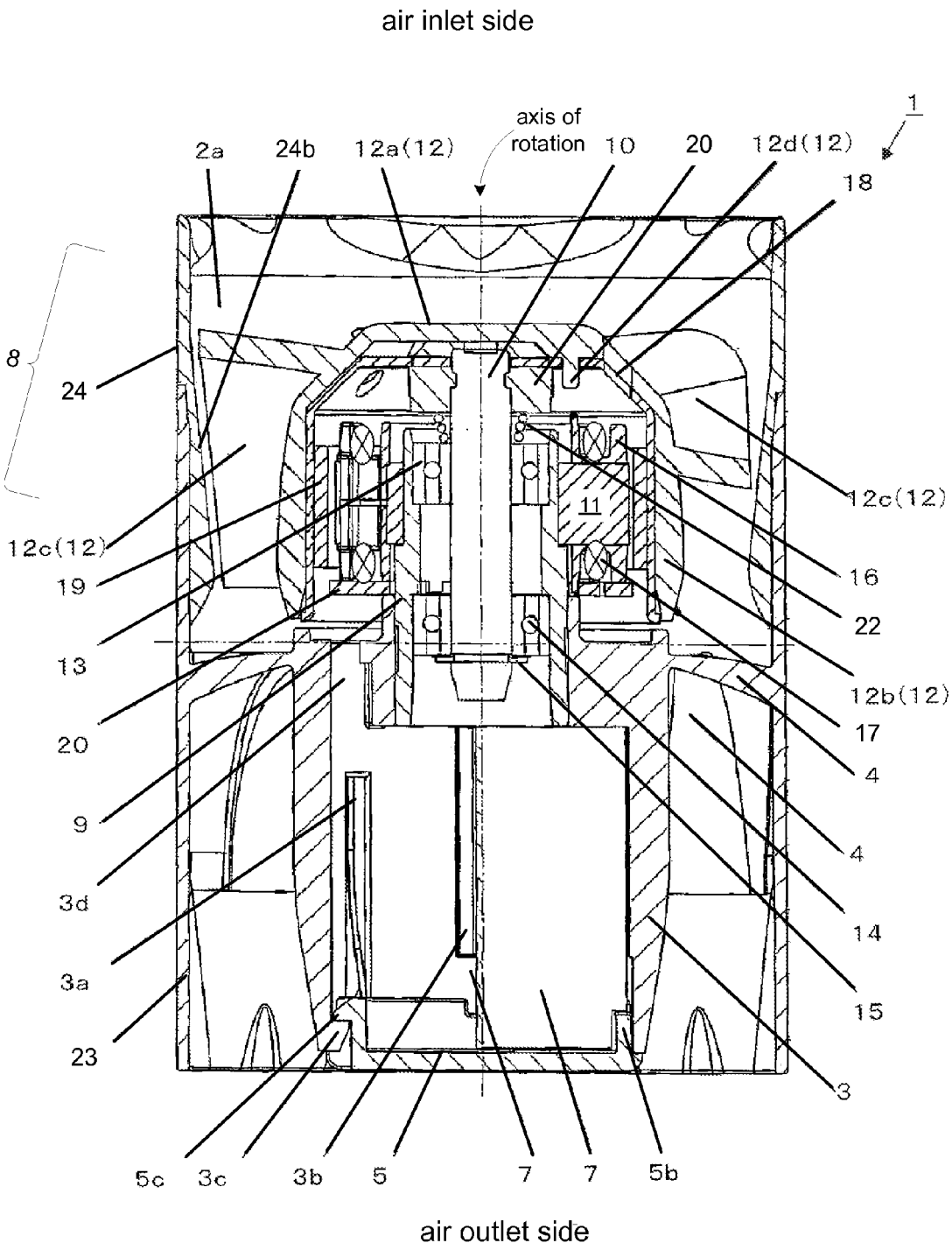
FIG. 3 shows a cross sectional view of FIG. 1 when cut along the view line A-A.

FIG. 3 shows a cross-sectional view of an embodiment of the present invention taken from view line A-A in FIG. 1. The air flow opening 2*a* can be formed in the center of inlet housing ring 24 and the base housing 23. A circuit board storage compartment 3 may be provided and disposed within the air flow opening 2*a*. In an embodiment, the circuit board storage compartment 3 can be coupled to the plurality of fixed fan blades 4 (in a particular embodiment, there are 8 such blades). The fixed fan blades 4 may be disposed around the outer peripheral surface of the circuit board storage compartment 3 and connected to the inside wall of the base housing 23. The air flow opening 2*a* in the base housing 23 has a radius R4 (referring to FIG. 5).

In embodiments, the base housing 23, the circuit board storage 3, and fixed fan blades 4 may be formed integrally by conventional injection molding processes. The base housing 23 may be formed as a single part by known injection molding processes using conventionally known resin materials such as synthetic resin including PBT, ABS, and the like. In embodiments, the fixed fan blades 4 may be equally spaced in a circumferential direction on the outer peripheral surface of the circuit board storage 3. Each fan blade 4 may be curved suitably.

Figure 4:
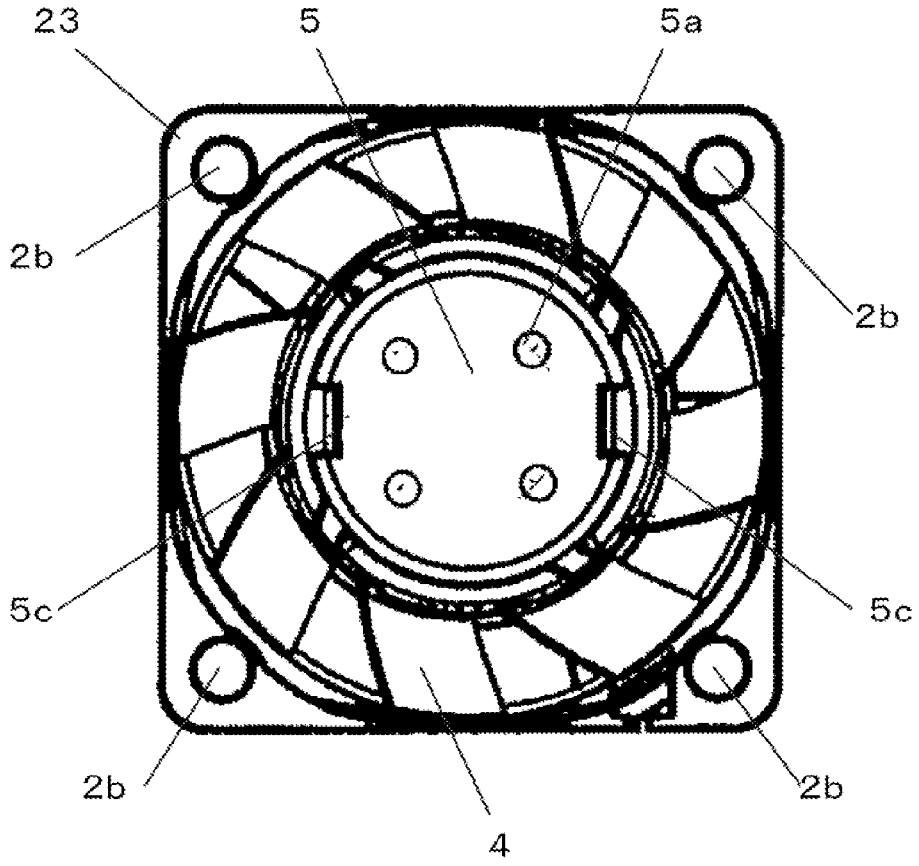
FIG. 4 shows a bottom plan view of an axial flow fan device in accordance with an embodiment of the present invention.

Referring to FIGS. 3 and 4, in embodiments, the circuit board storage compartment 3 may include an open end for assembly and access to circuit board(s) disposed in the compartment. A base cover 5 may be provided to cover the open end of the circuit board storage compartment 3 in order to prevent intrusion of foreign particles inside of the circuit board storage compartment. Locking claws 3*c* may be formed in a plurality of places on an end surface of the bottom surface of the circuit board storage compartment 3. The base cover 5 may include a boss 5*b* that inserts into a slot provided in the circuit board storage compartment 3. The locking claw 3*c* can be locked to a stepped portion 5*c* formed on the base cover 5.

A plurality of grooves 3*a* extending in the axial direction may be formed along the periphery of the circuit board storage compartment 3. For example, in an embodiment, four such grooves 3*a* formed equally spaced apart are provided. These grooves 3*a* provide access into the interior volume of the circuit board storage compartment 3 from the outside so that wiring and such can be brought into the circuit board storage compartment.

In embodiments, a guide 3*b* can be provided within the circuit board storage compartment 3 to facilitate the positioning of a circuit board 7. The circuit board 7 may include various electronic components to drive and control the axial flow fan device 1. The circuit board 7 may be positioned and stored inside of the circuit board storage compartment 3 by plugging in the circuit board 7 along the guide 3*b*. After positioning the circuit board 7 within the circuit board storage compartment 3, a pushing spring (not shown) can be inserted inside of the circuit board storage compartment to a hook (not shown) formed inside of the circuit board storage compartment. The circuit board 7 can thus be held and remain installed inside the circuit board storage compartment 3 by operation of the pushing spring pushing on one end of the circuit board 7. The pushing spring configuration is one of any of a number of conventionally known mechanisms for securing the circuit board 7 within the circuit board storage compartment 3. In embodiments, the circuit board 7 can be installed within the circuit board storage compartment 3 with its long axis aligned along the axial direction. This arrangement may accommodate circuit boards of any size while being able to maintain the axial flow fan device to a small radial size.

The ring part 24*b* of the housing ring 24 can be press fit to the inside of the base housing 23, in order to attach the housing ring 24 to the base housing 23. During this process, the key part 25 formed on the outer peripheral surface of the ring part 24*b* and extending in the axial direction, can be inserted and locked into a corresponding key groove 26 formed inside of the base housing 23. By this process, the housing ring 24 and the base housing 23 may be joined together and movement in the rotational direction can be prevented when they are joined together. In each corner of the base housing 23, the mounting receptacle 23*a* can be formed and the housing ring 24 pressed into the base housing 23 until the end surface is attaches to the bottom surface of the flange 24*a* of the housing ring 24.

A fan motor 8 can be disposed on an upper surface of the circuit board storage compartment 3. The fan motor 8 may comprise a cylindrical shaped bearing support 9, a shaft 10, a stator core 11, and bearings 13, 14. The impeller 12 can be connected to the shaft 10 of the fan motor 8.

The cylindrical shaped bearing support 9 may be fixed firmly in the center part of the circuit board storage compartment 3. Two bearings 13 and 14 may be supported inside the bearing support 9 with a predetermined spacing. The shaft 10 can be inserted into the bearings 13 and 14 and supported in a freely rotating manner. A C-shaped retaining ring 15 can be attached to one end of the shaft 10, to determine the position and prevent slipping of the shaft.

The stator core 11 may be formed of multi-layered cores and may be attached to the outer periphery of the bearing support 9. An insulator 16 can be attached to the stator core 11. A coil 17 may be wound around the insulator 16.

The impeller 12 can be connected to the fan motor 8. The outer periphery of the impeller main body 12*a* comprises a hub 12*b* having a plurality of fan blades 12*c* equally spaced about the hub. Each fan blade 12*c* may have an airfoil shaped cross-section, having a front (leading) edge and a back (trailing) edge and having an original curvature suitable for receiving or guiding air flow or any other fluid. A back yoke 18 having a circular duct shape with the bottom covered may be inserted into the inner periphery of the hub 12*b* of the impeller 12. The impeller 12 can be attached to the back yoke 18 by inserting the boss 12*d* formed integrally inside of the impeller main body 12*a* into a hole formed on the bottom of the back yoke 18.

Permanent magnets 19 may be attached to the inner periphery of the back yoke 18. The central part of the back yoke 18 may include a boss part 20 made of aluminum die-cast. The other end of the shaft 10 may be formed integrally with the back yoke 18 by the boss part 20. Thus, the impeller 12 can be connected to the other end of the shaft 10 and configured in such a way that as the shaft 10 rotates, the fan blades 12*c* rotate about the shaft 10. A coil spring 21 acting as a pre-compression spring may be fitted between the boss part 20 and an inner ring of the bearing 13 to give pre-compression to the bearings 13 and 14.

In embodiments, the impeller 12 may be formed as a single part by injection molding processes; for example, using known resin materials (such as engineering plastics like PBT, ABS, etc.).

Electrical connections between the fan motor 8 that is disposed outside of the circuit board storage compartment 3 and the circuit board 7 disposed inside circuit board storage compartment can be provided using a flexible printed circuit (FPC) that feeds through the groove 3*a*. One end of the FPC is connected to a PCB substrate 20 to which a terminal of the coil 17 of the fan motor 8 may be connected. The other end of the FPC may be connected to the circuit board 7 through a through hole 3*d* formed on the upper surface of the circuit board storage 3.

Figure 5:
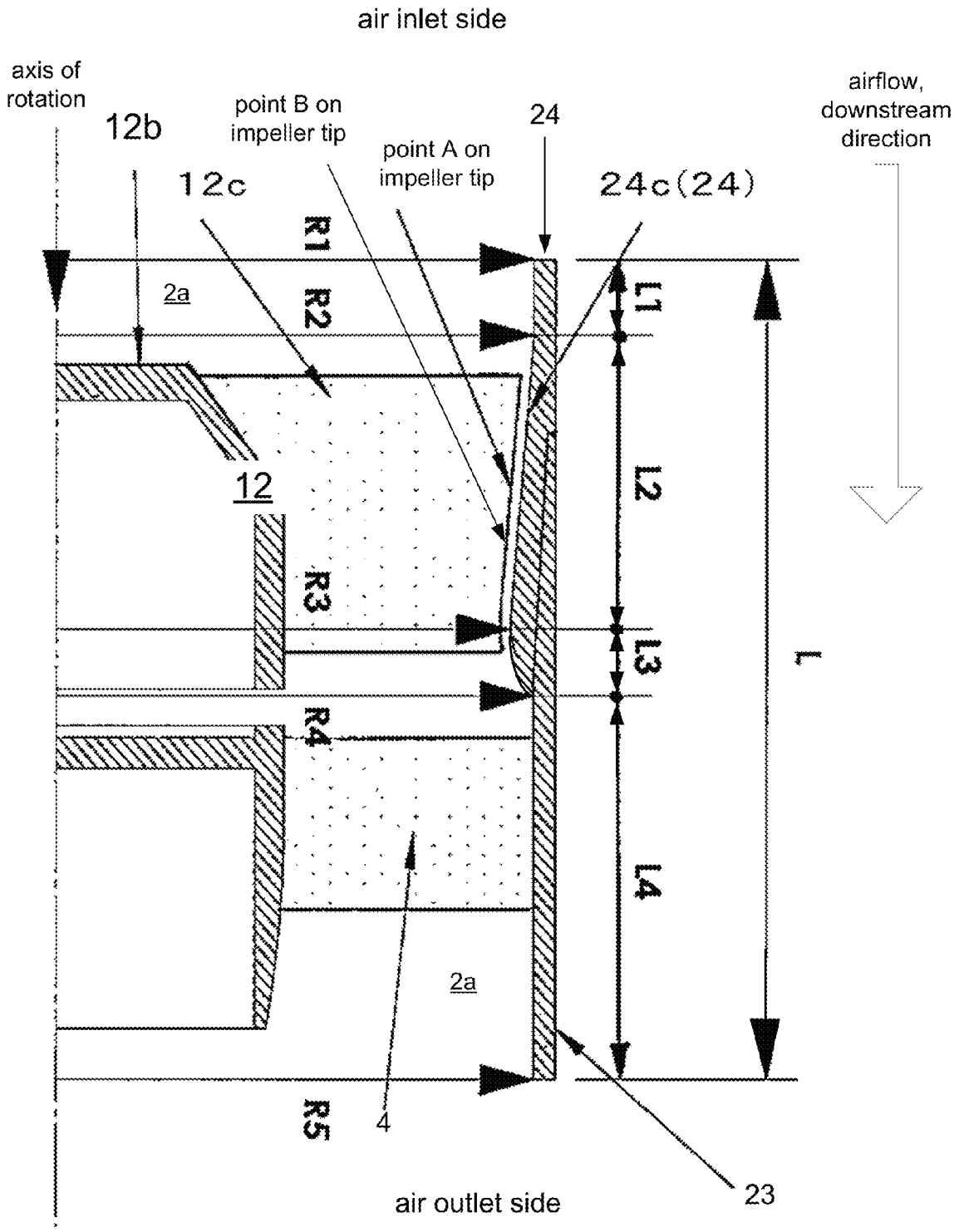
FIG. 5 is a schematic cross-sectional illustration showing positional relationships of components of an axial flow fan device in accordance with an embodiment of the present invention.

Referring to FIG. 5, a simplified cross-sectional diagram of a fan according to the present invention is shown. In embodiments, a venturi may be formed on an inner peripheral surface 24*c* of the housing 24. The inner peripheral surface 24*c* can be a tapered surface having its inner radius (the distance measured from the axis of rotation toward the inner surface) narrowing from an air inlet side to an air outlet (exhaust) side formed in the inner peripheral surface. In an embodiment, the inner radius (R) of the inlet housing ring 24 remains substantially constant in the segment L1; e.g., R1=R2. In the segment L2 of the inlet housing ring 24, the inner radius decreases and is tapered in the downstream axial direction; e.g., R2>R3 until the inner radius reaches a minimum at the beginning of segment L3. Then, for the length of segment L3, the inner radius increases in the downstream direction, until it reaches the radius R4 at the beginning of segment L4 where the radius may remain substantially constant.

FIG. 5 shows two points, A and B, on the impeller tip contour that is swept out by the fan blades 12*c* during rotation of the impeller 12. As the impeller 12 rotates, its fan blades 12*c* sweep out a cylindrical volume of space. The circumferential perimeter of that volume of space is referred to as the "tip contour" of the impeller 12. The tip contour may also be viewed as a surface defined by the tips of the fan blades 12*c* as the impeller 12 rotates.

Returning to FIG. 5, in an embodiment, the radial distance (i.e., distance measured from the axis of rotation) of the impeller tip contour of impeller 12 at point A will be different from the radial distance of the impeller tip contour at point B. In other words, the flow cross-sectional area is shrinking because the tip is "falling" in the downstream direction. This falling tip will result in a downstream area expansion. Stated differently, both the rotating impeller tip of impeller 12 and the stationary shroud (inlet housing ring 24) are "falling." Falling as used herein will be understood to mean that the radius decreases in the direction from the leading edge of the fan blade 12*c* toward the trailing edge of the fan blade. In an embodiment, the fall is linear. However, in other embodiments, other falling tip contours may be used.

A falling tip contour (FTC) reduces the overall pressure-rise per the centrifugal effect which forces the near-tip streamlines to fall (migrate inwards). In an embodiment, the magnitude of the fall in tip is preferably less than 12% and is computed as the % reduction in radius=[(R2−R3)/R2]×100%. These measurements are illustrated in the cross-sectional view of the fan housing 2 shown in FIG. 4. The radial measurements R1 to R5 of the airflow opening 2*a* are measured from the axis of rotation. The measurements R1, R2 are the radial distance from the axis of rotation to the inner surface 24*c*, measured at the inlet of the inlet housing ring 24. The figure illustrates that for a distance L1 from the inlet, the inside radius of the inlet housing ring 24 is substantially constant.

In an embodiment, the inner surface 24*c* of the inlet housing ring 24 has an inward taper such that the radius of the airflow opening 2*a* decreases in the downstream direction to a measurement R3; thus, R3<R2. In an embodiment, the taper spans about a distance L2 as shown in FIG. 5. The taper of the inner surface 24*c* then reverses and increases in a remaining segment of the inlet housing ring 24 for a distance L3, increasing the cross-sectional area of the airflow opening 2*a* from R3 to R4. In an embodiment, the airflow opening 2*a* in the base housing 23 can be substantially constant; e.g., R4≅R5. The inward taper and outward taper of the inner surface 24*c* of the inlet housing ring 24 creates an area of expansion in the region of L3. This geometry allows the exhaust air velocity to slow down without a loss of total pressure thus reducing the level of sound power (noise levels) during fan operation.

In another embodiment, the area expansion can be accomplished by expanding the area downstream of the impeller 12. Accordingly, the area downstream of the impeller 12 can be expanded by enlarging the diameter of the base housing 23 (i.e. by making R4 larger than R1). Such a configuration however, while certainly valid, may not be desirable from a cost-to-manufacture point of view because it could increase the unit volume and cost of the device.

In an embodiment, such as shown in FIG. 5, the area expansion can be provided in the inlet housing ring 24. The radius increases rapidly from R3 to R4 over a very short axial-length L3. The radius R2 (=R1, fan inlet radius) of the inlet housing ring 24 before (upstream of) the impeller may be about equal to the radius R4 (=R5, fan exit radius) of the base housing 23 after (downstream of) the impeller.

In an embodiment, the flow cross-sectional area may shrink rapidly over the first ½ of the axial-length (L) of the fan housing 2 due to the RHC (rising hub contour) and FTC (falling tip contour), and slowly over the remainder due to CHC (constant hub contour) and FTC. The reduction of pressure due to the FTC is more than compensated for per the rising hub contour (RHC), this is because the impeller is extremely efficient.

Referring to FIG. 3, the impeller tip contour of the impeller 12 and the contour of the inner surface 24*c* of the inlet housing ring 24 are shown "falling" in the axial downstream direction. Because the overall diameter of the inlet housing ring 24 is fixed, the fall in the tip allows for area expansion. It is noted that the fan housing wall thickness can be the same along the length of the fan housing 2.

If the distance between an edge side of the air inlet of the air flow opening 2*a* of the fan housing 2 and the fan blades 12*c* of the impeller 12 is too small, then this can depress the middle region of the static pressure (P) vs. air volume (Q) graph of the fan characteristics. It was discovered that a minimum spacing is about 5 mm.

Figure 5A:
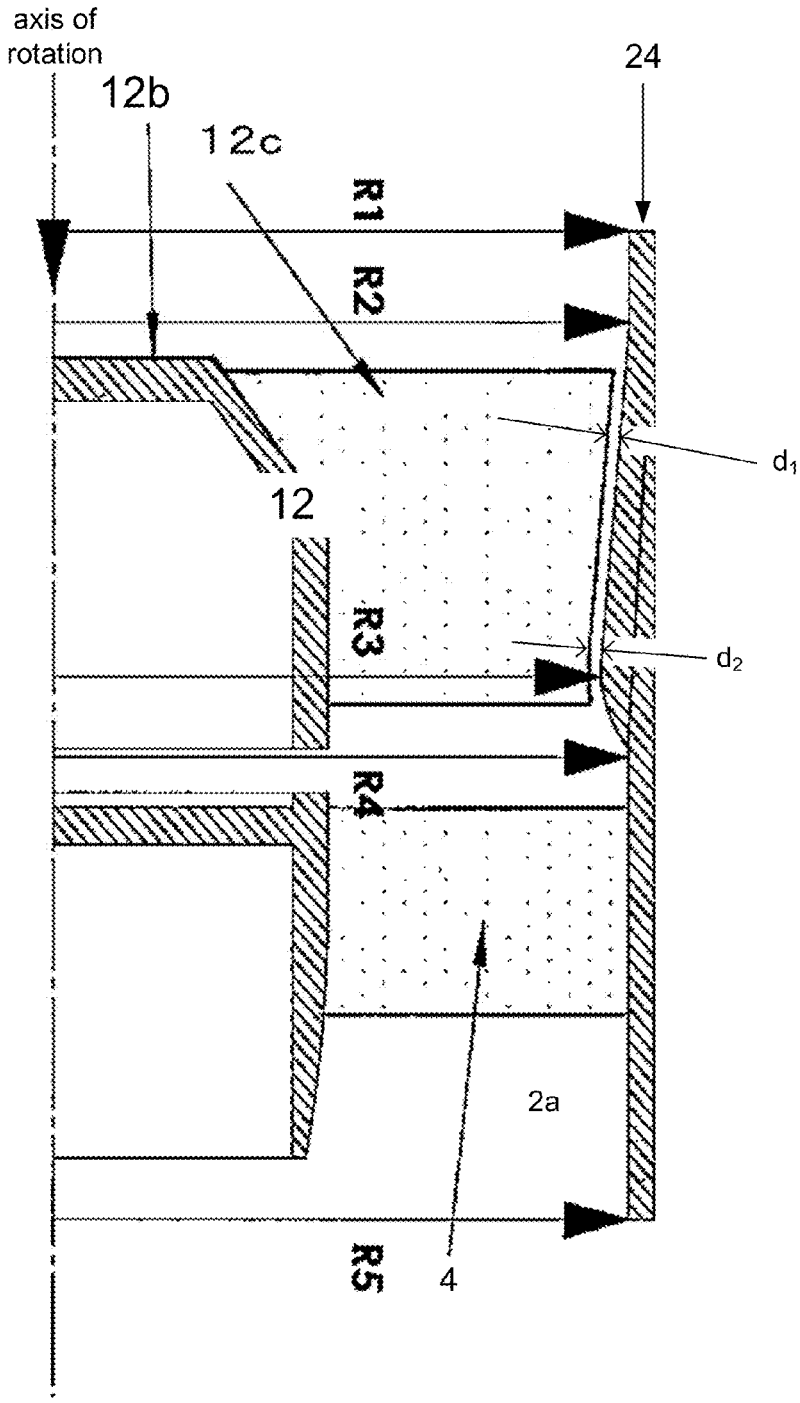
FIG. 5A illustrates the separation distance between the tip contour of the impeller 12 and the inner wall of the inlet housing ring 24.

As shown in FIG. 5A, in embodiments, the separation d between the tip contour of the impeller 12 and the tapered surface 24*c* of the inner periphery of the inlet housing ring 24 can be substantially constant along the length of the tip contour in the axial direction. Thus, $d_1$ represents the separation between the tip contour of the impeller 12 and the tapered surface 24*c* near the inlet side, and $d_2$ represents the separation between the tip contour of the impeller 12 and the tapered surface 24*c* near the outlet side, where $d_1$ can be substantially equal to $d_2$.

Operation of the axial flow fan device will now be discussed. The impeller 12 is rotated by turning on the fan motor 8 by supplying DC power with a predetermined voltage to the axial flow fan motor device. Air inside the unit in which the axial flow fan is placed is sucked into the air inlet at the air flow opening 2*a* by the rotation of the impeller 12. The air that is taken in flows into the air flow opening 21 from the air inlet. The air is guided by the tapered surface 24*c* and flows inside. The air guided by the tapered surface 24*c* passes between the rotating fan blades 12*c* and the tapered surface 24*c*.

Because the space between the rotating fan blades 12*c* and the tapered surface 24*c* is formed with a nearly constant distance (i.e., $d_1$ is substantially equal to $d_2$), noise is suppressed without generating air flow disturbances during passage of the air between the rotating fan blades 12*c* and the tapered surface 24*c*. The inclined surface is formed on the inner peripheral surface of the housing 24 having a cross sectional area increasing from the position of a back end (exhaust opening side) R3 of the rotating fan blades 12*c* to the air flow opening 2*a* (meaning the inner diameter is increasing).

The air that passes through is guided and rectified by the stator blades 4, and the direction of air flow is changed to produce flow in a direction of the axis. This flow of air becomes a flow along the stator blades 4 and changes angular flow momentum into linear momentum to reduce dissipation of the flow energy and increase the static pressure level. The airflow thus passes smoothly between the stator blades 4 and is exhausted through side face of the housing 2 with reduced levels of sound power (reduced fan noise).

The air guided by the stator blades 4 passes near the groove 3*a* formed around periphery of the circuit board storage 3. A part of this air passes through the groove 3*a* and is exhausted through a plurality of the air flow openings 5*a* disposed on the base cover 5. Because of this, heat generated from the circuit board 7 and confined inside the circuit board storage compartment 3 can be exhausted outside of the circuit board storage 3 by this flow of air through the groove 3*a*. Thus, the heat confined inside of the circuit board storage compartment 3 can be efficiently dissipated through this cooling and a thermal runaway of the electronic parts mounted on the circuit board 7 can be prevented.

What is claimed is:

1. An axial flow fan apparatus comprising:

a housing;

a motor disposed within the housing; and an impeller disposed within the housing and connected to the motor, the impeller comprising a plurality of fan blades, the housing comprising:

a first portion within which the impeller is disposed for rotation about an axis of rotation;

a second portion disposed downstream of the first portion; and a plurality of stator blades fixedly disposed within the second portion about the axis of rotation, the first portion having an inside diameter that decreases with traverse from an air inlet side of the housing toward an air outlet side of the housing, wherein the inside diameter increases with traverse from a location that is proximate a trailing edge of the fan blades toward the air outlet side, the second portion having a compartment disposed therein along the axis of rotation, the stator blades formed on an outer portion of the compartment, the compartment having a circuit board disposed therein, the circuit board in electrical communication with the motor.

2. The apparatus of claim 1 wherein an inside diameter of the second portion of the housing is substantially constant along the axial direction of the second portion of the housing.

3. The apparatus of claim 1 wherein a tip contour of the impeller remains spaced apart from the inside wall of the first section by a substantially constant distance, d.

4. The apparatus of claim 3 wherein the distance, d, is at least 5 mm.

5. The apparatus of claim 1 wherein the impeller further comprises a hub to which the fan blades attach, the hub having a rising hub contour.

6. The apparatus of claim 1 wherein the second portion of the housing is separable from the first portion of the housing.

7. An axial flow fan device comprising:

a housing having a circular opening therethrough along an axis of rotation;

a circuit board storage supported and connected by fixed fan blades to an inner part of the housing;

a motor disposed on an upper side of the circuit board storage; and an impeller having fan blades and connected to a shaft of the motor for blowing air, wherein an inner surface of the housing comprises a tapered surface along an axial direction having an inner diameter decreasing from an air inlet side to an air exhaust side on an inner peripheral surface of the housing, wherein the inner diameter increases from a position proximate trailing edges of the fan blades, wherein a spacing between tips of the fan blades and the tapered surface is substantially constant, and wherein the fixed fan blades are disposed proximate an air exhaust opening side of the rotating fan.

8. The fan according to claim 7, wherein the impeller further has a hub to which the fan blades are attached, the hub having a rising hub contour.

9. The fan according to claim 7, wherein a circuit board including electronic parts used to drive the motor is disposed inside of the circuit board storage.

10. The fan according to claim 9 wherein the circuit board is oriented in an axial direction.

11. The fan according to claim 7, wherein the housing comprises a base housing and a housing ring, wherein the fixed fan blades are disposed inside the base housing, the tapered surface is formed on an inner surface of the housing ring, and the base housing and the housing ring are connected by a position determining means.

12. The fan according to claim 7, wherein the position determining means comprises a groove formed on an inner surface of the base housing and a key part formed on an outer surface of the housing ring.

13. The fan according to claim 7, wherein a circuit board including electronic parts used to drive the motor is disposed inside of the circuit board storage.

14. The fan according to claim 13 wherein the circuit board is oriented in an axial direction.

* * * * *